US005882007A

United States Patent [19]

Gay

[11] Patent Number: 5,882,007

[45] Date of Patent: Mar. 16, 1999

[54] PUCK GAME SYSTEM

[76] Inventor: Dale A. Gay, 11165 Roberts Rd., Chunchula, Ala. 36521

[21] Appl. No.: 916,647

[22] Filed: Aug. 22, 1997

[51] Int. Cl.[6] ..... A63B 67/04; A63F 7/06

[52] U.S. Cl. ..... 273/108.1; 273/126 R

[58] Field of Search ..... 273/108, 108.1, 273/108.5, 126 R, 285, 287

[56] References Cited

U.S. PATENT DOCUMENTS

| | | | |
|---|---|---|---|
| 1,593,421 | 7/1926 | Blum | 273/108.5 |
| 2,252,451 | 8/1941 | Anderson | 273/108 |
| 2,824,739 | 2/1958 | Frank | 273/126 R |
| 2,960,339 | 11/1960 | Bush . | |
| 4,076,242 | 2/1978 | Joseph . | |
| 4,560,163 | 12/1985 | Erickson | 273/108.5 X |
| 4,765,622 | 8/1988 | Rienzo | 273/108.5 |
| 4,775,152 | 10/1988 | Roehl | 273/108.7 |
| 4,872,679 | 10/1989 | Bohaski et al. | 273/108 X |
| 5,074,556 | 12/1991 | Loeppky et al. | 273/108.5 |
| 5,417,421 | 5/1995 | Bagley | 273/108.5 |
| 5,433,443 | 7/1995 | Ples . | |
| 5,556,094 | 9/1996 | Shiledar Baxi | 273/108.5 |

*Primary Examiner*—Raleigh W. Chiu

*Attorney, Agent, or Firm*—Joseph N. Breaux

[57] ABSTRACT

A puck game system that includes at least two puck striking implements; a least one disk shaped puck; and a two-part hinged game arena assembly; the two-part hinged game arena assembly including identical left and right arena structures, each arena structure including: a substantially rectangular housing having a hinge connecting side secured to three low profile hinge assemblies; two spaced puck transfer openings formed through the hinge connecting side and positioned in a manner such that the two spaced transfer openings of the left arena structure are in registration with the two spaced transfer openings of the right arena structure when the left and right arena structures are pivoted into the fully open position, each of the puck transfer openings being of sufficient size to allow passage of the at least one disk shaped puck therethrough; two transfer opening gasket structures secured about the opening perimeter of each puck transfer opening and to the exterior of the hinge connecting sidewall; a rectangular goal opening centered on and formed through the handle connecting sidewall, the goal opening being of sufficient size to allow passage of the at least one disk shaped puck therethrough; a puck catching net attached to the handle connecting sidewall around the perimeter of the rectangular goal opening; and a handle extending outwardly from the exterior of a handle connecting sidewall.

9 Claims, 2 Drawing Sheets

PUCK GAME SYSTEM

TECHNICAL FIELD

The present invention relates to game systems and more particularly to a puck game system that includes at least two puck striking implements; a least one disk shaped puck; and a two-part hinged game arena assembly; the two-part hinged game arena assembly including identical left and right arena structures, each arena structure including: a substantially rectangular housing having a hinge connecting side secured to three low profile hinge assemblies; two spaced puck transfer openings formed through the hinge connecting side and positioned in a manner such that the two spaced transfer openings of the left arena structure are in registration with the two spaced transfer openings of the right arena structure when the left and right arena structures are pivoted into the fully open position, each of the puck transfer openings being of sufficient size to allow passage of the at least one disk shaped puck therethrough; two transfer opening gasket structures secured about the opening perimeter of each puck transfer opening and to the exterior of the hinge connecting sidewall; a rectangular goal opening centered on and formed through the handle connecting sidewall, the goal opening being of sufficient size to allow passage of the at least one disk shaped puck therethrough; a puck catching net attached to the handle connecting sidewall around the perimeter of the rectangular goal opening; and a handle extending outwardly from the exterior of a handle connecting sidewall.

BACKGROUND OF THE INVENTION

Many individuals enjoy playing games that require a puck to be driven into an opponents goal area. It would be a benefit to those individuals to have a puck game system that could be easily positioned onto a flat surface before each play session and removed and stored within a closet or beneath a bed after the play session is over. In addition, it would be a further benefit if the puck game system included one or more handles to ease movement of the game system between the storage area and the game site.

SUMMARY OF THE INVENTION

It is thus an object of the invention to provide a puck game system.

It is a further object of the invention to provide a puck game system that is easily positioned onto a flat surface before each play session and removed and stored after the play session is over.

It is a still further object of the invention to provide a puck game system that included one or more handles to ease movement of the game system between the storage area and the game site.

It is a still further object of the invention to provide a puck game system that includes at least two puck striking implements; a least one disk shaped puck; and a two-part hinged game arena assembly; the two-part hinged game arena assembly including identical left and right arena structures, each arena structure including: a substantially rectangular housing having a hinge connecting side secured to three low profile hinge assemblies; two spaced puck transfer openings formed through the hinge connecting side and positioned in a manner such that the two spaced transfer openings of the left arena structure are in registration with the two spaced transfer openings of the right arena structure when the left and right arena structures are pivoted into the fully open position, each of the puck transfer openings being of sufficient size to allow passage of the at least one disk shaped puck therethrough; two transfer opening gasket structures secured about the opening perimeter of each puck transfer opening and to the exterior of the hinge connecting sidewall; a rectangular goal opening centered on and formed through the handle connecting sidewall, the goal opening being of sufficient size to allow passage of the at least one disk shaped puck therethrough; a puck catching net attached to the handle connecting sidewall around the perimeter of the rectangular goal opening; and a handle extending outwardly from the exterior of a handle connecting sidewall.

It is a still further object of the invention to provide a puck game system that accomplishes some or all of the above objects in combination.

Accordingly, a puck game system is provided. The puck game system includes at least two puck striking implements; a least one disk shaped puck; and a two-part hinged game arena assembly; the two-part hinged game arena assembly including identical left and right arena structures, each arena structure including: a substantially rectangular housing having a hinge connecting side secured to three low profile hinge assemblies; two spaced puck transfer openings formed through the hinge connecting side and positioned in a manner such that the two spaced transfer openings of the left arena structure are in registration with the two spaced transfer openings of the right arena structure when the left and right arena structures are pivoted into the fully open position, each of the puck transfer openings being of sufficient size to allow passage of the at least one disk shaped puck therethrough; two transfer opening gasket structures secured about the opening perimeter of each puck transfer opening and to the exterior of the hinge connecting sidewall; a rectangular goal opening centered on and formed through the handle connecting sidewall, the goal opening being of sufficient size to allow passage of the at least one disk shaped puck therethrough; a puck catching net attached to the handle connecting sidewall around the perimeter of the rectangular goal opening; and a handle extending outwardly from the exterior of a handle connecting sidewall.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
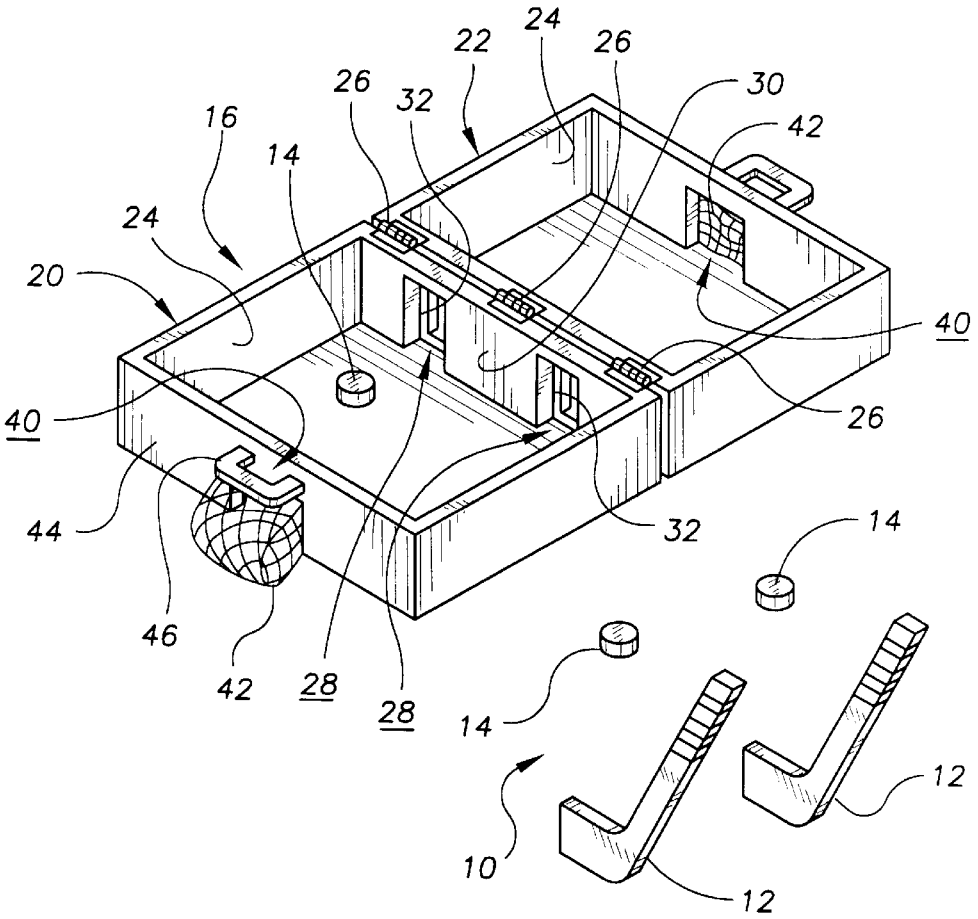
FIG. 1 is a perspective view of an exemplary embodiment of the puck game system of the present invention showing the two hockey sticks; the three high density plastic pucks; and the two-part hinged game arena assembly including the identical left and right arena structures wherein each arena structure includes a substantially rectangular housing having a hinge connecting side secured to three low profile hinge assemblies, two spaced puck transfer openings formed through the hinge connecting side and positioned in a manner such that the two spaced transfer openings of the left arena structure are in registration with the two spaced transfer openings of the right arena structure when the left and right arena structures are pivoted into the fully open position, the two transfer opening gasket structures secured about the opening perimeter of each puck transfer opening and to the exterior of the hinge connecting sidewall, a rectangular goal opening centered on and formed through the handle connecting sidewall, a nylon mesh puck catching net attached to the handle connecting sidewall around the perimeter of the rectangular goal opening; and the U-shaped handle extending outwardly from the exterior of the handle connecting sidewall.

FIG. 1 shows an exemplary embodiment of the puck game system of the present invention generally designated by the numeral 10. In this embodiment, game system 10 includes two wooden hockey sticks 12; three high density plastic pucks 14; and a two-part hinged game arena assembly, generally designated 16. Two-part hinged game arena assembly 16 includes identical left and right arena structures, generally designated 20,22. Each arena structure 20,22 includes a substantially rectangular molded plastic housing 24 that is connected to the other housing 24 by three low profile hinge assemblies 26.

Figure 2:
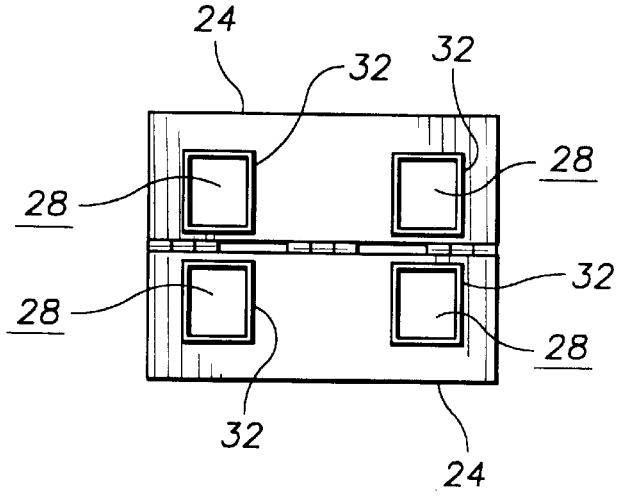
FIG. 2 is a first side plan view of the two-part hinged game arena assembly of the puck game system of FIG. 1 with the identical left and right arena structures pivoted into the closed position and showing the two transfer opening gasket structures secured about the opening perimeter of each puck transfer opening and protruding from the exterior of the hinge connecting sidewall of the left arena structure; and the two transfer opening gasket structures secured about the opening perimeter of each puck transfer opening and protruding from the exterior of the hinge connecting sidewall of the right arena structure.
Figure 3:
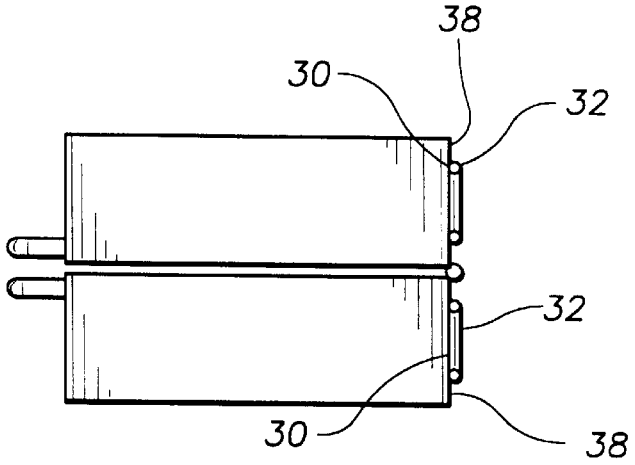
FIG. 3 is a second side plan view of the two-part hinged game arena assembly of the puck game system of FIG. 1 with the identical left and right arena structures pivoted into the closed position and showing one of the two transfer opening gasket structures of the left arena structure and one of the two transfer gasket structures of the right arena structure protruding outwardly from the exterior of its respective arena structure.
Figure 4:
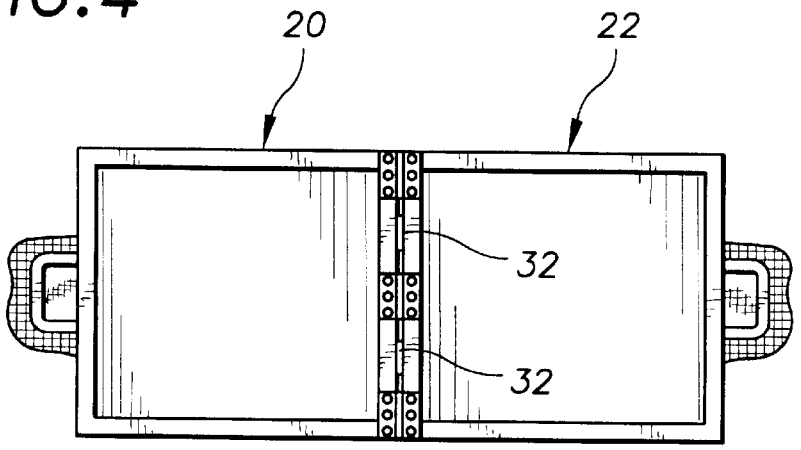
FIG. 4 is a third side plan view of the two-part hinged game arena assembly of the puck game system of FIG. 1 with the identical left and right arena structures pivoted into the open position showing the two transfer opening gasket structures of the left arena structure in contact with the two transfer opening gasket structures of the right arena structure to form a smooth puck sliding surface between each of the aligned pairs of puck transfer openings.

Each housing 24 has two spaced, rectangular shaped, puck transfer openings 28 formed through a hinge connecting sidewall 30. Transfer openings 28 are positioned in a manner such that the two spaced transfer openings 28 of left arena structure 20 are in registration with the two spaced transfer openings 28 of right arena structure 22 when left and right arena structures 20,22 are pivoted into a fully open position. With reference to FIG. 2, each housing 24 includes two integrally molded transfer opening gasket structures 32, one formed about the perimeter of each puck transfer opening 28. With reference to FIG. 3, each transfer opening gasket structure 32 extends away from the exterior surface 38 of hinge connecting sidewall 30 a distance such that when, with reference to FIG. 4, the left and right arena structures 20,22 are pivoted into a fully open position, the two transfer opening gasket structures 32 of left arena structure 20 contact the two transfer opening gasket structures 32 of right arena structure 22 and provide a continuous puck sliding surface between the left and right arena structure 20,22.

With reference back to FIG. 1, each hosing 24 also includes a goal opening 40 that has a nylon mesh puck catching net 42 attached to a handle connecting sidewall 44 thereof. An U-shaped handle structure 46 is also provided to ease transportation of game system 10. Game system 10 can be used as desired by the user to play a variety of user created puck based games such as box hockey, etc.

It can be seen from the preceding description that a puck game system has been provided that is easily positioned onto a flat surface before each play session and removed and stored after the play session is over; that includes one or more handles to ease movement of the game system between the storage area and the game site; and that includes at least two puck striking implements; a least one disk shaped puck; and a two-part hinged game arena assembly; the two-part hinged game arena assembly including identical left and right arena structures, each arena structure including: a substantially rectangular housing having a hinge connecting side secured to three low profile hinge assemblies; two spaced puck transfer openings formed through the hinge connecting side and positioned in a manner such that the two spaced transfer openings of the left arena structure are in registration with the two spaced transfer openings of the right arena structure when the left and right arena structures are pivoted into the fully open position, each of the puck transfer openings being of sufficient size to allow passage of the at least one disk shaped puck therethrough; two transfer opening gasket structures secured about the opening perimeter of each puck transfer opening and to the exterior of the hinge connecting sidewall; a rectangular goal opening centered on and formed through the handle connecting sidewall, the goal opening being of sufficient size to allow passage of the at least one disk shaped puck therethrough; a puck catching net attached to the handle connecting sidewall around the perimeter of the rectangular goal opening; and a handle extending outwardly from the exterior of a handle connecting sidewall.

It is noted that the embodiment of the puck game system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A puck game system comprising:

at least two puck striking implements;

a least one disk shaped puck; and a two-part hinged game arena assembly;

said two-part hinged game arena assembly including identical left and right arena structures, each said left and right arena structure including:

a housing having a hinge connecting side secured to three low profile hinge assemblies;

two spaced puck transfer openings formed through said hinge connecting side and positioned in a manner such that said two spaced transfer openings of said left arena structure are in registration with said two spaced transfer openings of said right arena structure when said left and right arena structures are pivoted into said fully open position, each of said puck transfer openings being of sufficient size to allow passage of said at least one disk shaped puck therethrough;

two transfer opening gasket structures integrally molded with and formed about the perimeter of each said. puck transfer opening, each said transfer opening gasket. structure extending away from an exterior surface of said hinge connecting side a distance such that when said left and right arena structures are pivoted into said fully open position, said two transfer opening gasket structures of said left arena structure contact said two transfer opening gasket structures of said right arena structure and provide a continuous puck sliding surface between said left and right arena structures;

a rectangular goal opening centered on and formed through a handle connecting sidewall, said goal opening being of sufficient size to allow passage of said at least one disk shaped puck therethrough;

a puck catching net attached to said handle connecting sidewall around said perimeter of said rectangular goal opening; and a handle extending outwardly from said exterior of said handle connecting sidewall.

2. The puck game system of claim 1, wherein:

each of said housings is of molded plastic construction.

3. The puck game system of claim 2, wherein:

said at least two puck striking implements are hockey stick shaped.

4. The puck game system of claim 2 wherein:

said pucks are constructed of plastic.

5. The puck game system of claim 3 wherein:

said pucks are constructed of plastic.

6. The puck game system of claim 1, wherein:

said at least two puck striking implements are hockey stick shaped.

7. The puck game system of claim 6 wherein:

said pucks are constructed of plastic.

8. The puck game system of claim 1 wherein:

said pucks are constructed of plastic.

9. The puck game system of claim 8 wherein:

said two transfer opening gasket structures of each of said left and right arena structures are constructed of the same material as each of said housings.

* * * * *